US006945798B2

(12) United States Patent
McClellan et al.

(10) Patent No.: US 6,945,798 B2
(45) Date of Patent: Sep. 20, 2005

(54) ELECTRONIC PACKAGE WITH SOCKET AND REINFORCED COVER ASSEMBLY

(75) Inventors: Justin Shane McClellan, Camp Hill, PA (US); Troy Conner, York, PA (US); Peter Paul Wilson, Palmyra, PA (US); Attalee S. Taylor, Palmyra, PA (US); Brett Charles Miller, East Berlin, PA (US); Matthew Richard McAlonis, Elizabethtown, PA (US); John Bossert Brown, Ann Arbor, MI (US); Richard Elof Hamner, Hummelstown, PA (US)

(73) Assignee: Tyco Electronics Corporation, Middletown, PA (US)

( * ) Notice: Subject to any disclaimer, the term of this patent is extended or adjusted under 35 U.S.C. 154(b) by 0 days.

(21) Appl. No.: 10/426,477

(22) Filed: Apr. 30, 2003

(65) Prior Publication Data

US 2004/0219808 A1 Nov. 4, 2004

(51) Int. Cl.[7] ..... H01R 13/44
(52) U.S. Cl. ..... 439/135; 439/940
(58) Field of Search ..... 439/135, 142, 439/331, 940

(56) References Cited

U.S. PATENT DOCUMENTS 3,960,423 A * 6/1976 Weisenburger ..... 439/66
4,144,648 A * 3/1979 Grovender ..... 439/331
4,826,440 A * 5/1989 Plocek et al. ..... 439/70
4,936,783 A * 6/1990 Petersen ..... 439/70
4,969,828 A * 11/1990 Bright et al. ..... 439/68
5,055,971 A * 10/1991 Fudala et al. ..... 361/760
5,236,367 A * 8/1993 McHugh et al. ..... 439/73
5,387,120 A * 2/1995 Marks et al. ..... 439/331
5,788,526 A * 8/1998 Twigg et al. ..... 439/331
5,882,221 A * 3/1999 Nguyen et al. ..... 439/331
5,975,915 A * 11/1999 Yamazaki et al. ..... 439/72

* cited by examiner

*Primary Examiner*—Michael C. Zarroli

(57) ABSTRACT

A cover for an electrical socket includes multiple walls joined with one another and configured to overlay an electrical socket. A latch element is provided with at least one of the walls to securely retain the walls against the electrical socket. A rigid member is secured to the walls and retains the walls in a predefined relation with respect to one another. The rigid member includes a heat resistant plate rigidly mounted to the walls of the cover which include lower edges and upper edges aligned in a common plane. The upper and lower edges are configured to abut against and retain the electrical socket in a common planar relation with one another. Brackets extending from the walls slidably receive the rigid member.

18 Claims, 6 Drawing Sheets

ELECTRONIC PACKAGE WITH SOCKET AND REINFORCED COVER ASSEMBLY

BACKGROUND OF THE INVENTION

The present invention relates generally to electrical sockets, and, more particularly, to electrical sockets that receive reinforced corners.

In some types of electronic packaging, electrical sockets are provided that are surface mounted to a printed circuit board. For example, land grid array ("LGA") and ball grid array ("BGA") packaging include socket structures surface mounted to printed circuit boards including a matrix of corresponding surface mounted flat pad structures upon each of which is deposited a small quantity of solder. To mount the socket structure to the circuit board, the socket is typically placed on an appropriate side of the circuit board, using a high accuracy "pick and place" machine, in a manner such that the solder lead portions of the socket contact a number of flat, surface mounted solder pads on the board. Once the socket is located on the board, the board is heated, causing the solder to melt, thereby fusing the corresponding surfaces together and yielding a strong mechanical and electrical connection when cooled.

Even slight nonplanarities in either or both of the circuit board and surface mounted electronic packages tend to compromise the electrical connections of the electronic package to the board. Consequently, nonplanarities of the board or the electronic package tend to significantly increase the probability of having to rework a significant portion of the fabricated circuit board/electronic package assemblies, thereby undesirably increasing assembly and reducing yield.

As the data transmission rates of modern electronic devices increase, the size of the electronic package to accommodate an increased number of signals is also increasing. For example, in at least one application, sockets are required that approach 74 mm in length. An increased size of the packages, however, tends to result in warping of the plastic sockets used in the packages as they are surface mounted to the board. Specifically, heat from the solder reflow process creates residual stress in the plastic socket as the socket cools, thereby causing the socket to warp and become nonplanar with respect to the circuit board. Distortion and deformation of the socket is an undesirable and unwelcome aspect of the surface mount electronic package assembly.

BRIEF DESCRIPTION OF THE INVENTION

A cover for an electrical socket is provided in accordance with one aspect of the present invention. The cover comprises multiple walls joined with one another and configured to overlay an electrical socket. A latch element is provided on at least one of the walls to securely retain the walls against the electrical socket. A rigid member is secured to the walls and retains the walls in a predefined relation with respect to one another.

Optionally, the said walls of the cover surround an opening that extends through the socket, and the rigid member spans the opening. In a further option, the rigid member includes a heat resistant plate rigidly mounted to the walls.

In another option, the walls of the cover include lower edges aligned in a common plane, and the lower edges are configured to abut against and retain the electrical socket in a common plane. In a further option, the walls include upper edges that abut against the rigid member which maintain the walls in a common planar relation with one another. In still another option, the walls include brackets that slidably receive the rigid member.

In accordance with another aspect of the present invention, the cover is provided with a latch beam that is pivotally mounted to one of the walls. The latch beam has a length oriented to extend along a length of one of the walls. The latch beam is configured to securely retain the electrical socket to the cover.

In accordance with still another aspect of the present invention, an electronic package is provided. The package comprises an electrical socket and a cover with multiple walls joined with one another and configured to overlay the electrical socket. A latch element is provided on at least one of the walls to securely retain the walls against the electrical socket. A rigid member is secured to the walls and retaining the walls in a predefined relation with respect to one another.

DETAILED DESCRIPTION OF THE INVENTION

Figure 1:
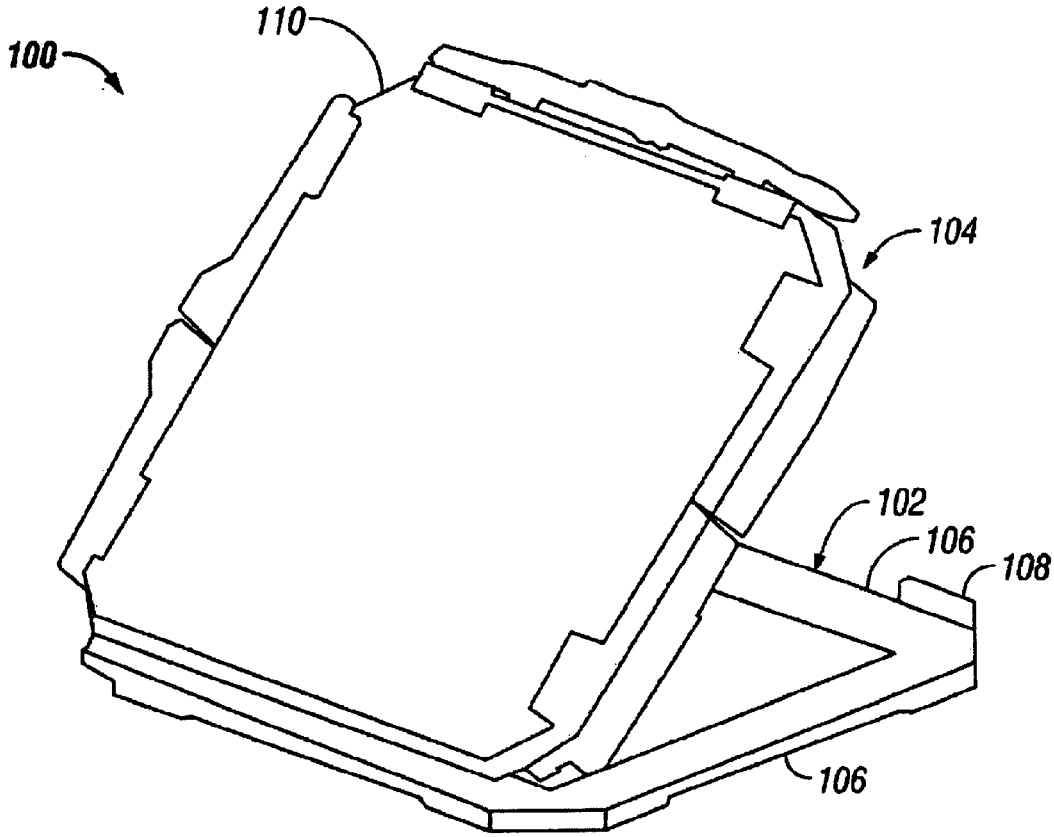
FIG. 1 is perspective view of an exemplary electronic package assembly formed in accordance with an embodiment of the present invention.

FIG. 1 is a perspective view of an exemplary electronic package 100 including a socket 102 and a cover assembly 104 attached to the socket 102. As explained in detail below, cover assembly 104 overlays socket 102 and prevents socket 102 from warping such as during solder reflow processes in surface mount installations and such as in ball grid array ("BGA") packaging. Package 100 is particularly suited for larger socket openings, such as for, example, a distributed power delivery system for an electronic device, although it is understood that the benefits of the invention and/or disclosed embodiments may be used in other applications. For example, while package 100 has been found to be advantageous for BGA packaging, it is recognized that package 100 may also be used in land grid array ("LGA") packaging. The embodiments described hereinbelow are therefore set forth for purposes of illustration rather than limitation, and the invention is not intended to be limited to any particular socket configuration or to sockets for any particular end application.

Socket 102, as further described below, is generally rectangular in shape in an exemplary embodiment and includes four sides 106 extending substantially perpendicular to one another and joined at respective ends thereof. Each side 106 of socket 102 includes a pair of projections or tabs 108, sometimes referred to as fences, extending upwardly therefrom for secure engagement with cover assembly 104. Socket 102 further includes a number of openings therein for receiving power and/or signal contacts of a mating electronic card interposer (not shown). In an illustrative embodiment, socket 102 is fabricated from known materials, including but not limited to injection molded plastic, and is configured for surface mounting to a printed circuit board (not shown). In other words, a bottom surface of socket 102 is substantially flat and coplanar to form a secure mechanical and electrical connection when surface mounted to the printed circuit board. While a generally rectangular socket configuration is illustrated, it is appreciated that other socket shapes having a greater or fewer number of sides may be employed. It is further recognized that a greater or fewer number of projections or tabs 108 may be employed.

As illustrated in FIG. 1, cover assembly 104 is generally complementary in shape to socket 102 and is configured to be hingedly attached to socket 102 through projections 108. Upstanding side walls extend about the remaining sides of cover assembly 104 and include pivotally mounted latch members thereon (explained further below) for securing cover assembly 104 to socket 102. Cover assembly 104 is adapted for use with a known pick and place machine for placement of socket 102 on the printed circuit board, and further is adapted to prevent warping and deformation of socket 102 during heating, such as during a solder reflow process. More particularly, cover assembly 104 includes a reinforcing rigid member 110 therein that is heat resistant and maintains socket 102 in a planar arrangement. Optionally, rigid member 110 is fabricated from a known metal, such as stainless steel into a flat, planar plate according to known processes or techniques. Alternative rigid member 110 may be fabricated from a known ceramic material according to a known process to produce a heat resistant reinforcement member that does not deform during heating and thereby maintains socket 102 in a planar arrangement.

Figure 2:
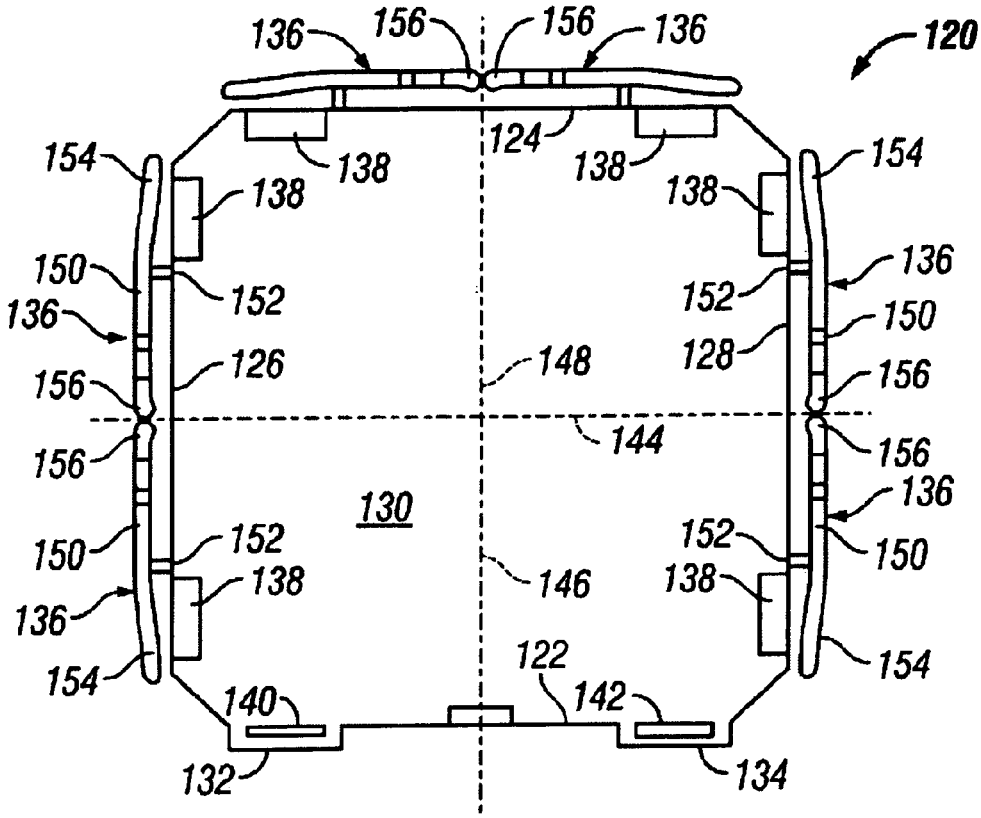
FIG. 2 is a top plan view of a cover for the socket assembly shown in FIG. 1 formed in accordance with an embodiment of the present invention.

FIG. 2 is a top plan view of pick and place cover 120 which receives rigid member 110 therein to form cover assembly 104 (shown in FIG. 1). As illustrated in FIG. 2, cover 120 is generally rectangular and includes four substantially orthogonal side walls 122, 124, 126, 128 with a planar top surface 130 extending therebetween and including angled corners between the side walls. While the top surface 130 of the cover 120 extends entirely between side walls 122, 124, 126, 128, it is understood that top surface 130 may include one or more openings therethrough in alternative embodiments without departing from the scope and spirit of the instant invention.

In an exemplary embodiment, one side wall 122 includes hinge elements 132, 134 extending therefrom, while the remaining three sides walls 124, 126, 128 include latch elements 136 depending outwardly therefrom. Side walls 124, 126, 128 further include brackets 138 extending upward above the top cover surface 130 and extending inward toward one another over a portion of the top surface 130. Each hinge element 132, 134 includes a respective slot 140, 142 for receiving projections 108 along one side of socket 102 (as shown in FIG. 1). Brackets 138 form a pocket for receiving the rigid reinforcement member 110 (shown in FIG. 1).

Latch elements 136 on the cover 120 are arranged in pairs along side walls 124, 126, 128 and are disposed symmetrically on either side of lateral and longitudinal axes 144, 146 extending through a center 148 of cover 120. Each latch element 136 includes a latch beam 150 extending substantially parallel to respective side walls 124, 126, 128. Each latch beam 150 is joined to the side walls 124, 126, 128 by a web 152 projecting substantially perpendicularly to the side walls 124, 126, 128. Latch beams 150 include grip portions 154 on lateral ends thereof. The grip portions 154 are located adjacent the cut-out corners of cover surface 130. The latch beams 150 also include rounded pivot ends 156 that are located adjacent cover axes 144, 146. In an exemplary embodiment, and as illustrated in FIG. 2, grip portions 154 extend inwardly from latch beams 150. As explained below, grip portions 154 resiliently receive projections 108 of socket 102 (shown in FIG. 1) and maintain the projections 108 between grip portions 154 and side walls 124, 126, 128.

Figure 3:
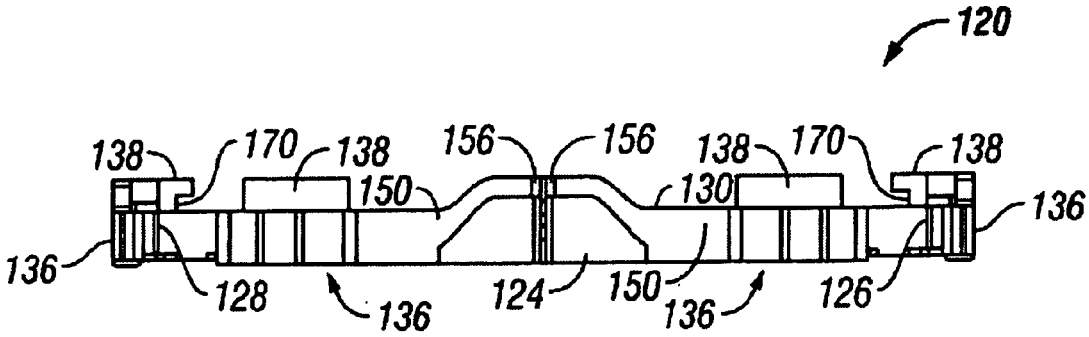
FIG. 3 is an end elevational view of the cover shown in FIG. 2 formed in accordance with an embodiment of the present invention.

FIG. 3 is an end elevational view of cover 120 to better illustrate brackets 138 extending upwardly from and extending over cover top surface 130. Each bracket 138 includes a slot 170 that receives an edge of rigid member 110 (shown in FIG. 1) in an interference fit to securely retain the rigid member 110 in a planar position with respect to cover 120. Thus, when cover assembly 104 (shown in FIG. 1) is engaged by vacuum pickups of a pick and place machine, cover 120 and rigid member 110 are maintained in their respective planar orientations, thereby imparting structural strength and stiffness to socket 102 (shown in FIG. 1) to resist heat-related stresses and deformation during solder reflow operations when surface mounting the electronic package.

As also illustrated in FIG. 3, latch members 136, and more specifically, latch beams 150 are elevated above cover surface 130 at pivot ends 156. As such, pivot ends 156 are located above rigid member 110 when the rigid member 110 is received in brackets 138. This clearance of the rigid member 110 allows pivot ends 156 to be actuated as explained below to release cover assembly 104 from the socket 102 after being soldered to the printed circuit board.

In an exemplary embodiment, cover 120 is integrally fabricated according to a known process, including but not limited to a molded piece fabricated from a high temperature nylon material A unitary construction suitable for transferring structural rigidity of rigid member 110 to socket 102 to maintain socket 102 in a planar relationship to the printed circuit board is thereby provided. It is contemplated, however, that other known materials (e.g. injection molded plastic and thermoplastic materials, metallic materials and alloys, and ceramic materials) and processes appropriate for those materials may be used in lieu of plastic molding to produce cover 120 in both integral construction and constructions of multiple pieces.

Figure 4:
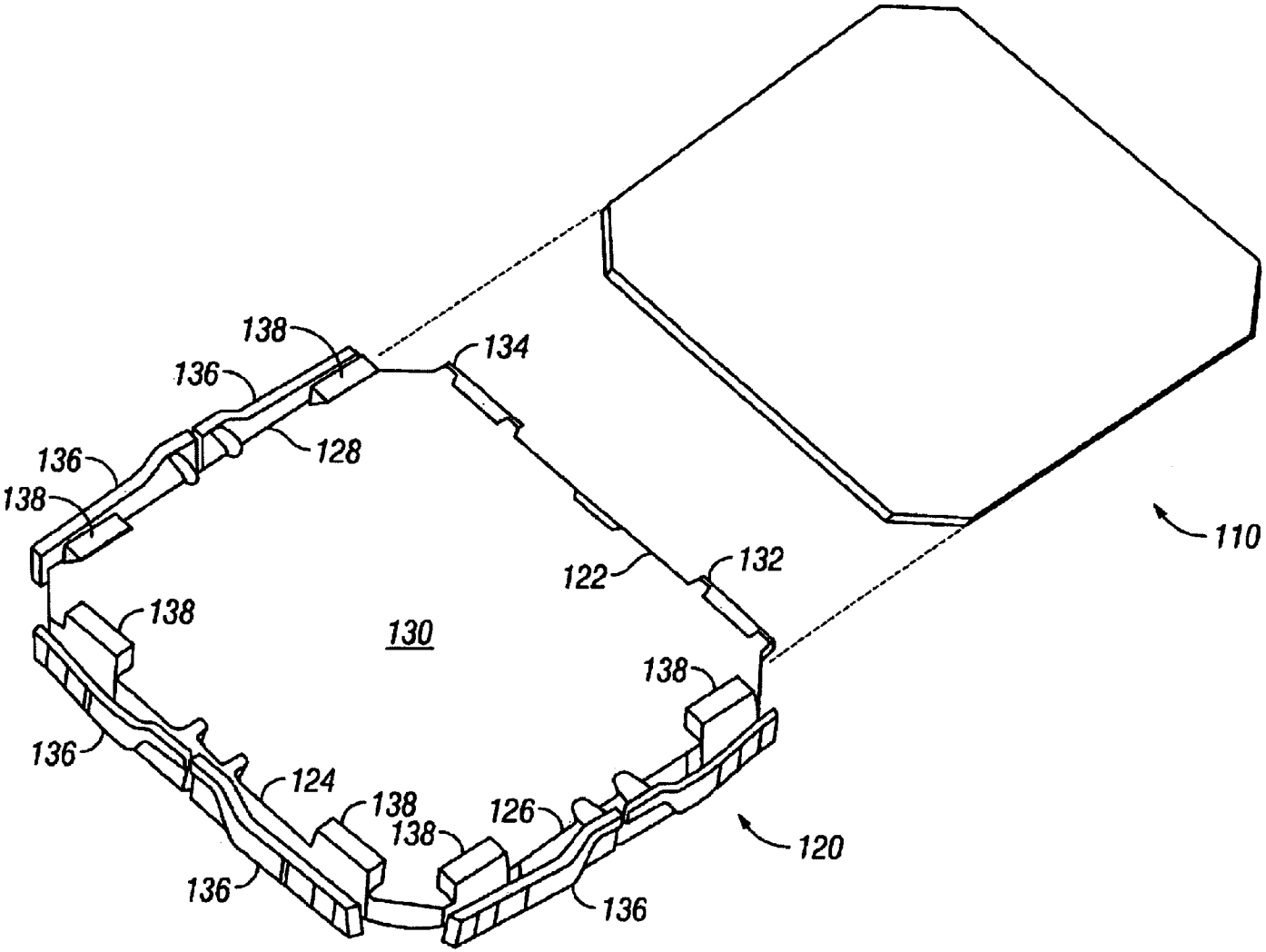
FIG. 4 is an exploded perspective view of a reinforced cover assembly for the package shown in FIG. 1 formed in accordance with an embodiment of the present invention

FIG. 4 is an exploded perspective view of rigid member 110 and cover 120. The rigid member 110 is fabricated into a planar element complementary in shape to the top surface 130 of the cover 120, and is dimensioned to a sufficient thickness to resist warping stresses in socket 102 and prevent deformation of socket 102 during heating. The rigid member 110 slides over top surface 130 and is snugly engaged in brackets 138 to complete cover assembly 104 (shown in FIG. 1). Due to the structural strength and rigidity of rigid member 110, the cover 120 need not be as structurally rigid as it would otherwise. Accordingly, cover 120 may be fabricated from less costly materials in a less costly manner while still ensuring that socket 102 is maintained in a coplanar relationship with the printed circuit board.

Figure 5:
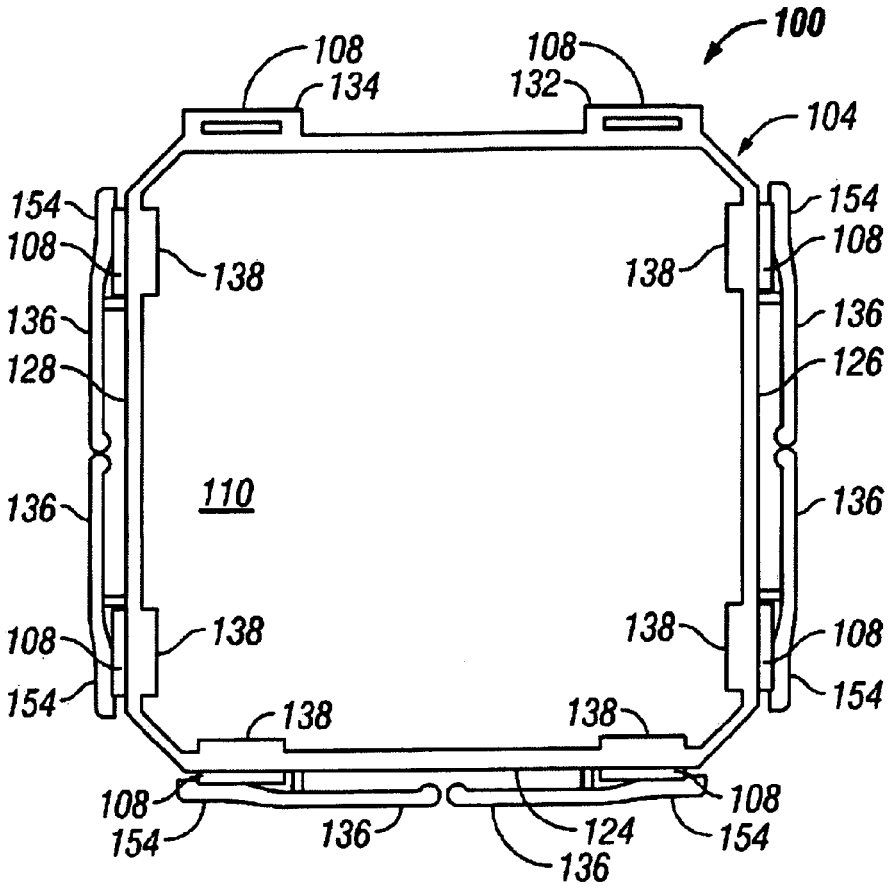
FIG. 5 is a top plan view of the package shown in FIG. 1 with the cover assembly in a latched position.

FIG. 5 is a top plan view of package 100 (shown in FIG. 1) illustrating cover assembly 104 attached to socket 102 in a latched position. The latch elements 136 are fitted over respective socket projections 108 along one side of the assembly 100. Along the remaining sides, socket projections 108 are received between outer surfaces of side walls 124, 126, 128 and grip portions 154 of latch elements 136. Rigid member 110 is received in brackets 138 and provides a sturdy reference plane to maintain socket 102 in a planar orientation and to counteract the tendency of the socket 102 to deform during solder reflow operations. When cover assembly 104 is attached to socket 102 in the latch position, package 100 may be positioned on a printed circuit board with a pick and place machine, and socket 102 may be surface mounted to the printed circuit board with a solder reflow operation.

Figure 6:
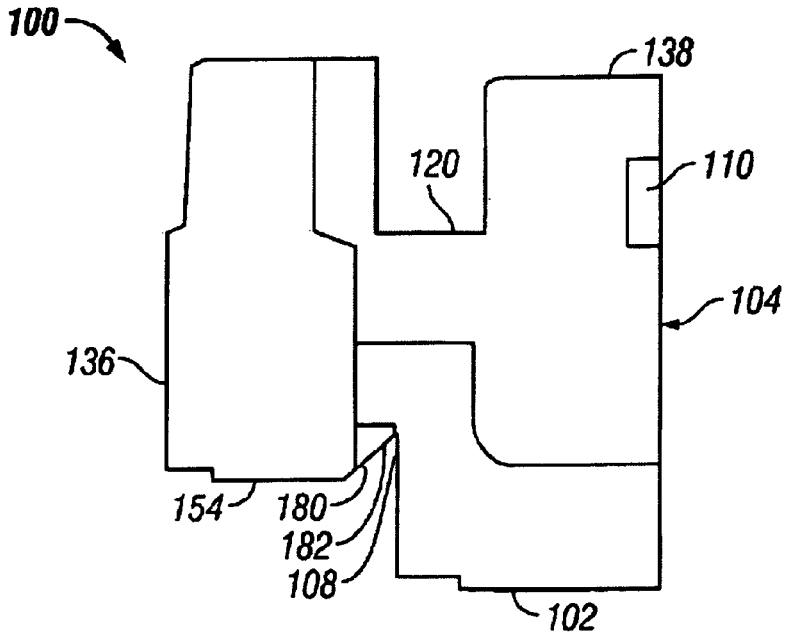
FIG. 6 is a magnified view of a portion of the package shown in FIG. 5.

FIG. 6 is a magnified view of a portion of package 100. The grip portion 154 includes a tapered shelf 180 extending beneath a lower surface 182 of one of socket projections 108. Thus, latch element 136 forms a wrap-around engagement with socket projection 108. Hence, when cover assembly 104 is lifted for positioning on a printed circuit board, tapered shelves 180 of latch elements 136 afford support from beneath socket projections 108. Gravitational forces tending to separate the cover assembly 104 and socket 102, when package 100 is lifted, are therefore counteracted. Accordingly, the socket 102 is maintained in a desired position relative to cover assembly 104.

A bottom surface of the grip portion 154 in FIG. 6 is located to extend a predetermined distance above the printed circuit board once the socket 100 is installed. For example, in one embodiment, a vertical clearance of greater than 2.0 mm is provided so that desired electrical components may be located underneath the grip portions 154 when the package 100 is installed on a circuit board. It is contemplated that greater or lesser clearances and other dimensional variations may be used for alternative installations of package 100.

Figure 7:
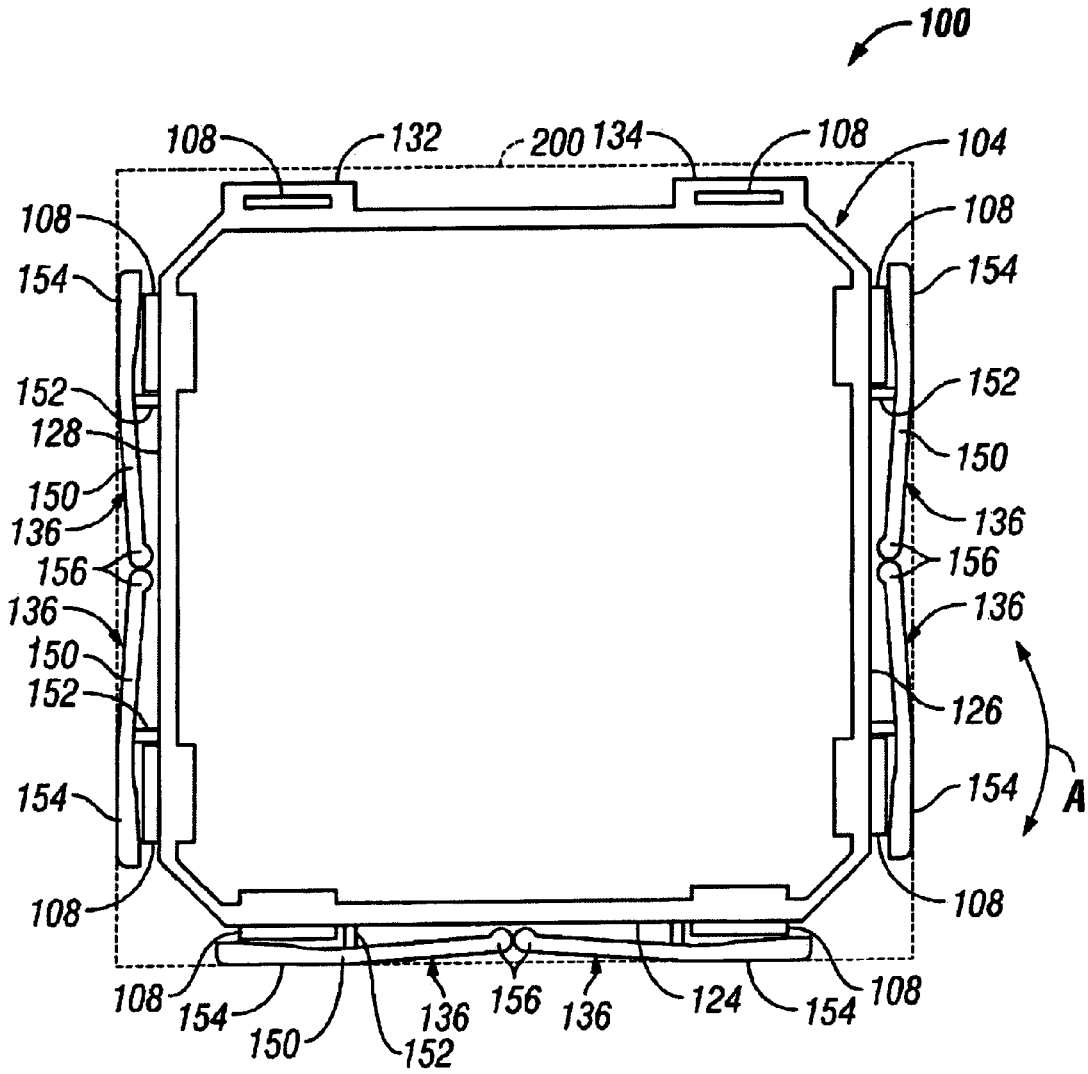
FIG. 7 is a top plan view of the package shown in FIG. 1 in an unlatched position.

FIG. 7 is a top plan view of electronic package 100 illustrating cover assembly 104 in an unlatched position for removal from socket 102 once solder reflow operations are complete. Latch elements 136 are actuated to the unlatched position by depressing pivot ends 156 inward toward respective side walls 124, 126, 128. As pivot ends 156 are depressed, latch beams 150 are pivoted about webs 152 where the latch elements 136 are attached to the side walls 124, 126, 128. In turn, grip portions 154 are deflected outwardly and away from respective side walls 124, 136, 128 until projections 108 are released from the grip portions 154. Once projections 108 are released, the cover 104 may be rotated upward about hinge elements 132, 134 (as shown in FIG. 1) until hinge elements 132, 134 are released from tab projections 108 and the cover assembly 104 may be removed. When the cover assembly 104 is removed, the socket 102 remains in secure mechanical and electrical connection to the printed circuit board in a planar relationship thereto.

Likewise, cover assembly 104 may be latched to socket 102 by inserting hinge elements 132, 134 socket projections 108 on one end of the socket 102, and rotating the cover assembly 104 downward about hinge elements 132, 134 toward socket 102. By depressing pivot ends 156, grip portions 154 are deflected outwardly as latch beams 150 pivot about webs 152. Hence, socket projections 108 may be aligned between side walls 124, 126, 128 and grip portions 154 as shown in FIG. 7. When the pivot ends 156 are released (i.e., not depressed) latch elements 136 resiliently return to the latched position (shown in FIG. 5) wherein cover assembly 104 is securely engaged to the socket 102.

In an illustrative embodiment, flexibility of the latch elements 136 to pivot about webs 152 is provided by the molded properties of the cover 120. In particular, the webs 152 are resilient in one direction (as denoted by arrow A in FIG. 7) to allow resilient flexing of latch elements 136 to latch or unlatch the cover assembly 104 to the socket 102. The arrow A represents an actuator path about an axis of rotation extending perpendicular to the plane containing the rigid member 110. In addition, the webs 152 are appreciably stiff in other directions to impart structural strength to the socket 102 to resist deformation of the side walls 124, 126, 128 along the axis of rotation. Specifically, webs 152 are stiff in a direction perpendicular to the surface of cover 120, together with side walls 124, 126, 128. As such, the rigid member 110 of the cover assembly 104 provides horizontal and vertical stiffness to the socket 102, while the cover 120 provides vertical stiffness to the socket 102 to maintain socket 102 in a planar position and orientation with respect to the printed circuit board.

According to another aspect of the present invention, and in an illustrative embodiment, the cover assembly 104 is configured to be maintained within a predetermined envelope 200 (shown in phantom in FIG. 7) regardless of whether the cover 120 is in the latched position (shown in FIG. 5) or the unlatched position (shown in FIG. 7). Interference of the latch elements 136 with other circuit board components is therefore avoided, and space on the printed circuit board is preserved. In an exemplary embodiment, envelope 200 is a square. It is appreciated that other design envelopes of various shapes and sizes may be provided in alternative embodiments and other applications of package 100.

Figure 8:
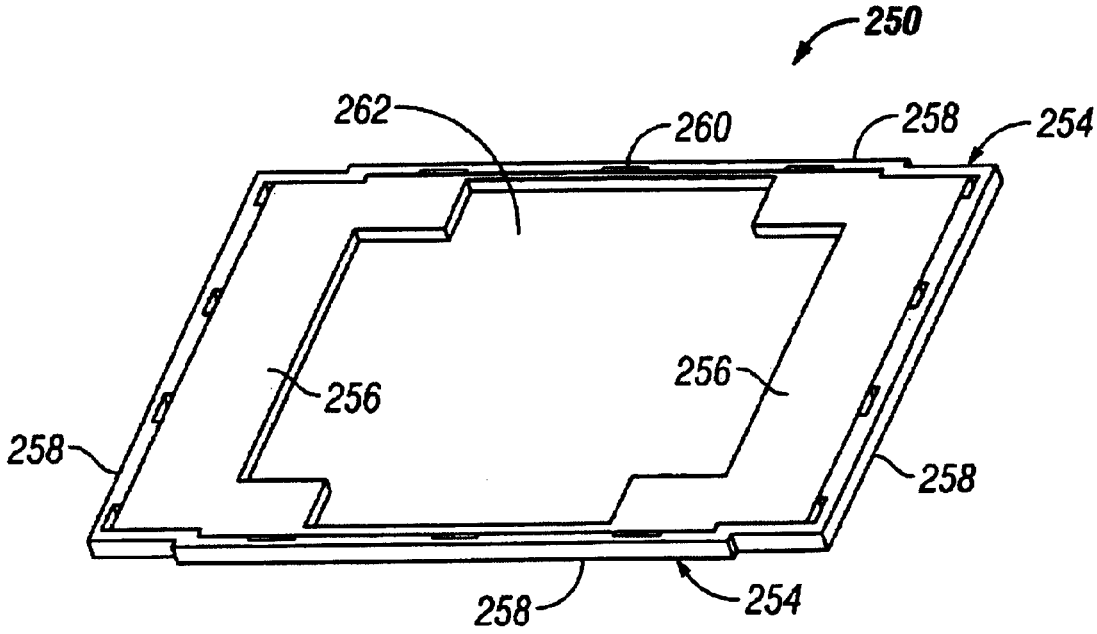
FIG. 8 is a perspective view of another embodiment of an electronic package.

FIG. 8 is a perspective view of another embodiment of a cover assembly for an electronic package 250 including a stiffening cover or frame 254 situated about a socket 256 and maintaining socket 256 in a coplanar position relative to a printed circuit board. The frame 254 includes multiple walls 258 extending generally complementary to the outer profile of the socket 256, and the socket 256 is received in the frame 254. Once the socket 256 is received in the frame 254, the socket and frame assembly is then located on the printed circuit board (not shown in FIG. 8) for solder reflow operations as described above. As illustrated in FIG. 8, the socket 256 includes oppositely positioned C-shaped elements contained in either end of the socket frame 254 and connected to one another. The C-shaped elements of socket 256 defines a cross-shaped opening 262 therebetween. It is contemplated, however, that in alternative embodiments the socket 256 may assume a variety of shapes defining various openings therebetween to accommodate various socket applications.

In an exemplary embodiment the socket 256 is fabricated from, for example, injection molded plastic according to known techniques, while the frame 254 is fabricated from metal. As such, the frame 254 is fabricated from a much stiffer or rigid material than the material from which the socket 156 is fabricated. The stiffness of the frame 254 resists heat related stress and deformation and maintains the socket 256 in a planar orientation relative to the printed circuit board. Further, in various embodiments, the frame 254 and the socket 256 may be fabricated from any of the foregoing materials and processes to produce suitable stiffness to resist deformation during solder reflow processes.

Figure 9:
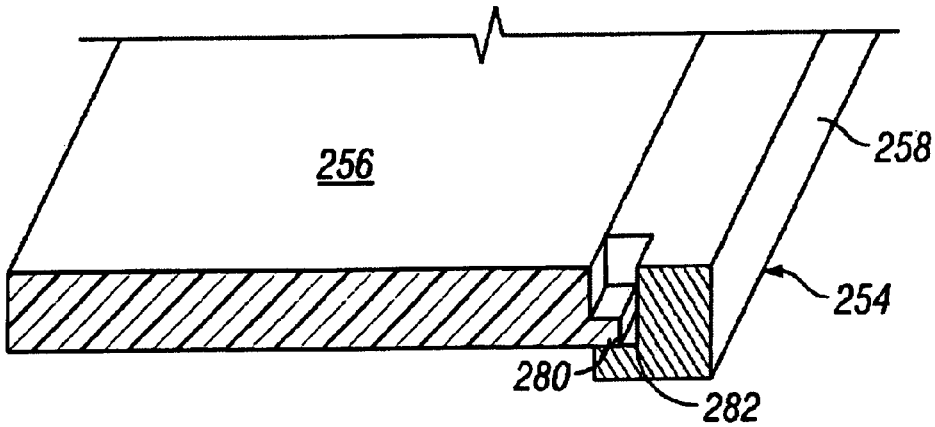
FIG. 9 is a partial cross sectional view of a portion of the socket and frame shown in FIG. 8.

FIG. 9 is a partial cross sectional view of a portion of the electronic package 250 illustrating an exemplary tongue-in-groove latch connection of the socket 256 within the frame 254. A side wall 258 of the frame 254 abuts against the socket 256 and retains the socket 256 in a planar position. Specifically, a tongue 280 extends laterally outward from the socket 256 and is received in a groove 282 extending on the interior portion of the frame 254. While in the illustrated embodiment the tongue 280 extends from an edge of the socket 256 and is received in the groove 282 extending in the interior surface of the frame 254, it is appreciated that in an alternative embodiment a tongue extending from the frame 254 could be accommodated by a groove in an edge of the socket 256. The tongue and groove arrangement may extend wholly or partially around the mating surfaces of the socket 256 and the frame 254 to provide a suitable latching engagement of the socket 256 and frame 254.

It is contemplated that in further and/or alternative embodiments, other connection and latch arrangements familiar to those in the art may be used to attach the socket 256 to the frame 254. Additionally, the socket 256 and/or the frame 254 may exhibit flexiblity to install and remove the socket 256 to the frame 254 while achieving a sufficient rigidity to withstand solder reflow operations without deformation. As such, associated nonplanarities of the socket and the printed circuit board are avoided.

While the invention has been described in terms of various specific embodiments, those skilled in the art will recognize that the invention can be practiced with modification within the spirit and scope of the claims.

What is claimed is:

1. A cover for an electrical socket, said cover comprising:

multiple walls joined with one another and configured to overlay an electrical socket, said walls fabricated from a first material;

a latch element provided with at least one of said walls to securely retain said walls against the electrical socket; and a rigid member separately provided from said walls and fabricated from a second material, said second material being different from said first material, said rigid member secured to said walls and retaining said walls in a predefined relation with respect to one another.

2. The cover of claim 1, wherein said latch element is adapted for tongue-in-groove engagement to secure said wall against the electrical socket.

3. The cover of claim 1, wherein said rigid member includes a heat resistant plate rigidly mounted to said walls.

4. The cover of claim 1, wherein said walls include lower edges aligned in a common plane, said lower edges being configured to abut against and retain the electrical socket in said common plane.

5. The cover of claim 1, wherein said walls include brackets that slidably receive said rigid member.

6. The cover of claim 1, wherein said walls include upper edges that abut against said rigid member which maintains said walls in a common planar relation with one another.

7. The cover of claim 1, wherein said latch element has at least one latch beam flexibly mounted to one of said walls, said latch beam having a length oriented to extend along a length of a corresponding one of said walls.

8. The cover of claim 1, wherein said latch element further comprises a latch beam provided along one of said walls, said latch beam being pivotal about an axis oriented perpendicular to a length of said one of said walls.

9. The cover of claim 1, wherein said latch element further comprises a pair of latch beams pivotally provided on, and extending along, one of said walls, said pair of latch beams being arranged in line with one another along a common axis.

10. The cover of claim 1, wherein said latch element further comprises latch beams pivotally provided on one of said walls, said latch beams being oriented to face in opposite directions, said latch beams having first ends proximate one another that are depressible to release the electronic socket.

11. A cover for an electrical socket, said cover comprising:

multiple walls joined with one another and configured to overlay an electrical socket; and a latch beam pivotally mounted to and extending outwardly from one of said walls, said latch beam having a length oriented to extend along a length of said one of said walls, said latch beam being configured to securely retain the electrical socket to said cover and, a pair of these latch beams extends along a common axis and are arranged end to end with one another.

12. The cover of claim 11, wherein said latch beam is pivotal about an axis oriented non-parallel to a length of said corresponding one of said walls.

13. The cover of claim 11, wherein said one of said walls is formed integrally with said latch beam, at an intermediate position along said latch beam.

14. The cover of claim 11, wherein said latch beam and said one of said walls are joined through a web, said web being flexible with respect to a longitudinal axis extending substantially perpendicular to said one of side walls and said web being rigid with respect to a transverse axis thereof.

15. The cover of claim 11, further comprising latch beams pivotally provided on one of said walls, said latch beams being oriented to face in opposite directions, said latch beams having first ends proximate one another that are depressible to release the electronic socket.

16. An electronic package, comprising:

an electrical socket; and a cover assembly comprising:

multiple walls fabricated from a first material, said multiple walls joined with one another and configured to overlay said electrical socket;

a latch element provided with at least one of said walls to securely retain said walls against the electrical socket; and a rigid member fabricated from a second material different from said first material, said rigid member secured to said walls and retaining said walls in a predefined relation with respect to one another and the rigid member includes a heat resistant plate rigidly mounted to said walls.

17. The electronic package of claim 16, wherein said latch element further comprises a latch beam provided along one of said walls, said latch beam being pivotal about an axis oriented perpendicular to a length of said one of said walls.

18. The electronic package of claim 16, wherein said latch element further comprises a pair of latch beams pivotally provided on, and extending along, one of said walls, said pair of latch beams being arranged in line with one another along a common axis.

* * * * *